US005137748A

United States Patent [19]

Fujiwara et al.

[11] Patent Number: 5,137,748

[45] Date of Patent: Aug. 11, 1992

[54] METHOD FOR ELECTROSTATIC COATING OF A RESIN MOLDING

[75] Inventors: Hidekazu Fujiwara, Yokohama; Kenji Motogami, Takatsuki; Shigeo Mori, Kyoto, all of Japan

[73] Assignees: Dai-Ichi Kogyo Keiyaku Co., Kyoto; Kanto Jidosha Kogyo Kabushiki Kaisha, Kanagawa, both of Japan

[21] Appl. No.: 580,154

[22] Filed: Sep. 10, 1990

[30] Foreign Application Priority Data

Sep. 13, 1989 [JP] Japan ..... 1-238270

[51] Int. Cl.[5] ..... B05D 1/06

[52] U.S. Cl. ..... 427/27; 427/407.1; 427/41

[58] Field of Search ..... 427/27, 28, 41, 407.1; 252/500, 518, 520

[56] References Cited

U.S. PATENT DOCUMENTS

| | | | |
|---|---|---|---|
| 3,671,504 | 6/1972 | Marumo et al. | 427/27 |
| 3,996,410 | 12/1976 | Gruetzman | 427/27 |
| 4,359,411 | 11/1982 | Kim et al. | 252/500 |
| 4,686,108 | 8/1987 | Nason et al. | 427/27 |
| 4,699,809 | 10/1987 | Maruhashi et al. | 427/230 |
| 4,740,426 | 4/1988 | Tremper, III | 428/423.7 |
| 4,855,077 | 8/1989 | Shikinami et al. | 252/500 |
| 4,872,910 | 10/1989 | Eshleman et al. | 252/500 |
| 4,957,660 | 9/1990 | Ohmae et al. | 252/500 |
| 4,978,473 | 12/1990 | Kuroda et al. | 252/500 |

FOREIGN PATENT DOCUMENTS

| | | |
|---|---|---|
| A353932A1 | of 0000 | European Pat. Off. . |
| A363103A2 | of 0000 | European Pat. Off. . |
| A418067A2 | of 0000 | European Pat. Off. . |
| A421612A2 | of 0000 | European Pat. Off. . |
| 167658 | 10/1983 | Japan . |
| 215366 | 12/1984 | Japan . |
| 99170 | 4/1990 | Japan . |
| 2118763A | of 0000 | United Kingdom . |
| 2172819 | of 0000 | United Kingdom . |

*Primary Examiner*—John Niebling
*Assistant Examiner*—Kishor Mayekar
*Attorney, Agent, or Firm*—Morgan & Finnegan

[57] ABSTRACT

An adhesive electrostatic coating is applied on a resin molding without substantially affecting the color and the physical properties by the method which comprises the steps of mixing with a resin a complex of a polyether and an electrolyte salt soluble in the polyether, molding the mixture, treating the resultant molding with plasma and then spray-coating an electrically charged paint on the surface of the treated molding. The polyether is selected from the group consisting of alkylene oxide polymers and copolymers, preferably selected from the group consisting of polymers of alkylene oxide having not less that 4 carbon atoms and block or random alkylene oxide copolymers containing not less than 10 weight % of at least one alkylene oxide unit having not less than 4 carbon atoms.

3 Claims, No Drawings

METHOD FOR ELECTROSTATIC COATING OF A RESIN MOLDING

BACKGROUND OF THE INVENTION

This invention relates to a method for applying an electrostatic coating on a resin molding.

As conventional methods for electrostatically coating a resin molding, there are included such as a method described in Japanese Laid-Open Patent Publication No. 66,538 of 1975 in which a conductive paint containing conductive metal powder is applied on the surface of a resin molding to form a conductive primer layer and then an electrostatic coating is performed, and a method in which an inorganic conductive substance such as carbon black, carbon fiber or conductive mica is mixed with the resin and the mixture is molded and then the molding is electrostatically coated.

However, these conventional methods for electrostatically coating a resin molding have the following disadvantages to cause difficulty in their practical uses.

For example, in the case of which a conductive primer layer is formed on the surface of a resin molding as described in Japanese Laid-Open Patent Publication No. 66,538 of 1975, the adhesion between the surface of the resin molding and the conductive primer applied on it is poor. To improve the adhesion, a multilayer of various conductive primer layers shall be necessarily formed. It causes not only difficulties in conductivity and productivity but also problems in the application loss and its cost due to the use of various types of conductive primer.

In the case of which an electrostatic coating is applied to a resin molding comprising a conductive substance such as carbon black, carbon fiber or conductive mica, the conductive substance shall be inevitably mixed with the resin in a large amount. Thus, it tends to cause the deterioration of the resin molding and affects the color of the surface of electrostatic coating by coloring the resin molding.

The object of the present invention is to provide a method of applying an electrostatic coating excellent in applicability and adhesion on a resin molding with no substantial deterioration in phyical properties and color of the resin.

SUMMARY OF THE INVENTION

We have found that the surface of a resin molding can be modified to be suitable for an electrostatic coating by mixing with a resin a complex of a specified polyether and an electrolyte salt, molding the mixture and then treating the surface of the molding with plasma and completed the present invention.

Thus, the method of the present invention is characterized in the steps of mixing with a resin a complex of a polyether and an electrolyte salt soluble in the polyether, molding the mixture, treating the resultant molding with plasma, and then spray-coating an electrically charged paint on the surface of the treated molding. The polyether is selected from the group consisting of alkylene oxide polymers and copolymers.

Detailed Description of the Invention

As a resin for the resin molding according to the invention, there may be used any resin having a high surface resistance, such as polyolefin resins, e.g., polyethylene and polypropylene, ABS resin, acrylic resin, polyamide resin, polyvinyl chloride resin, polycarbonate resin, polyacetal resin and phenolic resins.

Further, as a polyether used for the complex mixed with a resin for the resin molding, there may be used any polyether selected from the group consisting of alkylene oxide polymers and copolymers as described above. Generally, polymers of an alkylene oxide having not less than 4 carbon atoms and block or random alkylene oxide copolymers containing not less than 10 weight % of an alkylene oxide unit having not less than 4 carbon atoms are preferably used, and polymers or copolymers prepared with use of alkylene oxide having at least 6 carbon atoms are most preferably used.

In general, it is preferred to use, as the polyether, one prepared by performing the polymerization reaction by using the following active hydrogen compound as the starting material; such as monoalcohols, e.g., methanol and ethanol; dialcohols, e.g., ethylene glycol, propylene glycol and 1,4-butanediol; polyhydric alcohols, e.g., glycerol, trimethylol propane, sorbitol, sucrose and polyglycerol; amine compounds, e.g., monoethanolamine, ethylenediamine, diethylenetriamine, 2-ethylhexylamine and hexamethylene diamine; and phenolic active hydrogen-containing compounds, e.g., bisphenol-A and hydroquinone. It is especially preferred to use alcohols as the starting material.

Next, as the alkylene oxides, there are preferably used those having not less than 4 carbon atoms, such as α-olefine oxides having 4 to 9 carbon atoms, e.g., 1,2-epoxybutane, 1,2-epoxypentane, 1,2-epoxyhexane, 1,2-epoxyheptane, 1,2-epoxyoctane, 1,2-epoxynonane and the like; α-olefine oxides having not less than 10 carbon atoms; styrene oxide and the like. It is especially preferred to use an α-olefine oxides having 4 to 20 carbon atoms.

The polyethers may be either of homopolymers and block or randam copolymers. The sequence of the above alkylene oxides in the polyethers is not particularly limited. But it is preferred to be block or randam copolymers of at least one alkylene oxide having not less than 4 carbon atoms and ethylene oxide and/or propylene oxide. Further, block or random copolymers of at least one alkylene oxide having not less than 6 carbon atoms and ethylene oxide and/or propylene oxide are most preferably used. In the cases, it is required to contain not less than 10 weight %, more preferably not less than 50 weight %, of at least one alkylene oxide unit having not less than 4 carbon atoms. The end of the polymer may be terminated with an alkyl group such as methyl group and ethyl group.

The molecular weight of the polyether is preferably 1,000 to 100,000.

Furthermore, as the soluble electrolyte salts used to produce a complex with the polyether, there are exemplified such as inorganic salts, e.g., lithium chloride, lithium bromide, lithium iodide, lithium nitrate, lithium perchlorate, lithium thiocyanate, sodium bromide, sodium iodide, potassium thiocyanate, potassium iodide and lithium sulfonate; and organic salts, e.g., organic sulfonates and organic phosphates. The added amount is preferably 0.5 to 10 weight % based on the polyether.

The used amount of the complex of the polyether and the soluble electrolyte salt is preferably 1 to 10 weight %, more prefrably 1 to 5 weight % based on the resin. Though an addition of not less than 10 weight % of it is favorable for the improvement in electric conductivity, it causes deterioration of physical properties and surface bleeding disadvantageously due to the poor compatibility to the resin.

As the method for forming a complex between the polyether and the soluble electrolyte salt, a method is preferred in which the soluble electrolyte salt is previously dissolved in a single or mixed solvent highly compatible with the polyether, such as water, methanol, methyl ethyl ketone, tetrahydrofuran, acetone and methylene chloride and the solution is mixed uniformly with the polyether to give a complex solution and then the solvent is removed to give the complex.

As the method for mixing the complex between the polyether and the soluble electrolyte salt with the resin, any commonly used method can be used such as biaxial extrusion and hot rolling. As the molding method of the mixture, any commonly used method can be used such as injection molding, extrusion molding, calendering, compression molding and SMC process.

The plasma treatment is carried out by a procedure in which a low pressure oxidative gas such as oxygen or a mixed gas of nitrogen or argon with it is excited with high frequency discharge or micro wave discharge to form active gas and it is contacted with the surface of the product to be treated, namely molding. The pressure is usually 0.1 to 5 Torr, preferably 0.2 to 1.0 and the temperature is 40° to 100° C. and the treating period is 10 seconds to 10 minutes.

It is preferred that the treating gas contains 18 to 90 volume % of oxygen.

The electrostatic coating may be applied by any conventional method such as electric centrifugal method, air or airless spraying method and the like. The applied voltage may be about −60 KV to about −120 KV. Further, as the paint, there may be used any conventional ones such as urethane, acrylic, alkyd and melamine types.

Thus in the present invention, the cation of the soluble electrolyte salt of the above-mentioned complex mixed with the resin can move through the ether oxygen in the polyether and hence ionic conductivity is formed in the resin to lower its resistance. It exerts a synergetic effect together with the decrease in surface resistance due to the plasma treatment performed after molded to provide a resistance highly suitable for electrostatic coating and enables an electrostatic coating more excellent in applicability than ever.

PREFERRED EMBODIMENTS OF THE INVENTION

The following examples serve to illustrate the invention in more detail although the invention is not limited to the examples.

EXAMPLE 1

45 g of 1,4-butanediol as a starting material was put in a reactor and 550 g of 1,2-epoxybutane was gradually introduced in it by a usual method in the presence of potassium hydroxide as a catalyst. Then the product was purified by desalting to obtain 550 g of a polyether having a molecular weight of 1,100 (calculated from hydroxyl number) and containing 0.23 ppm of $K^+$.

A solution of 25 g lithium perchlorate in 100 g methanol was added to 500 g of the polyether with stirring to obtain a homogeneous solution and then methanol was removed in vacuo to obtain a complex.

30 g of the complex and 1 kg of polypropylene resin were mixed in a biaxial extruder at 180° C. for 10 min. and molded with a hot press method at the same temperature under a pressure of 50 kg/cm$^2$ for 2 min. and surface of the resultant molding (230 mm ×230 mm×3 mm) was treated with plasma in a gas containing 89 volume % of oxygen and 11 volume % of nitrogen at a gas flow rate of 6.75 l/min under a pressure of 0.2 mmHg at a temperature of 40° C. and at an outlet power of 1,200W for 1 min. to prepare a test piece.

Then the test piece was grounded and an urethane paint was applied on it by using a painting machine (μμBEL 30ϕ made by Ransburg-Gema AG) under an electrostatic voltage of −60 KV with a recipro stroke of 400 mm, a spray distance of 300 mm and a conveyor velocity of 2.2 m/min.

EXAMPLE 2

32 g of ethylene glycol was used as a starting material and 667 g of an ethylene oxide/propylene oxide mixture (molar ratio 4:1) was reacted with it in the presence of potassium hydroxide as a catalyst. Then a mixture of 496 g of α-olefine oxide having 12 carbon atoms and 1,334 g of propylene oxide was further reacted with the product and thus obtained product was purified by desalting to obtain 5,140 g of a polyether having a molecular weight of 4,970 (calculated from hydroxyl number) and containing 0.16 ppm of $K^+$.

A solution of 25 g of lithium perchlorate in 100 g of methanol was added to 500 g of the polyether with stirring to obtain a uniform solution and then methanol in the solution was removed in vacuo to obtain a complex.

70 g of the complex and 1 kg of polypropylene resin were mixed in a biaxial extruder at 180° C. for 10 min. and molded with a hot press method at the same temperature under a pressure of 50 kg/cm$^2$ for 2 min. (230 mm×230 mm×3 mm) and surface of the resultant molding was treated with plasma in a gas containing 89 volume % of oxygen and 11 volume % of nitrogen at a gas flow rate of 6.75 l/min under a pressure of 0.2 mmHg at a temperature of 40° C. and at an outlet power of 1,200 W for 1 min. to prepare a test piece.

Then the test piece was grounded and an urethane paint was applied on it by using a painting machine (μμ BEL 30 ϕ made by Ransburg-Gema AG) under an electrostatic voltage of −60 KV with a recipro stroke of 400 mm, a spray distance of 300 mm and a conveyor velocity of 2.2 m/min.

EXAMPLE 3

32 g of ethylene glycol was put in a reactor as a starting material and 1680 g of 1,2-epoxybutane was gradually introduced in it by a usual method in the presence of potassium hydroxide as a catalyst. The reaction product was purified by desalting to obtain 1,690 g of a polyether having a molecular weight of 3,100 (calculated from hydroxyl number) and containing 0.17 ppm of $K^+$.

A solution of 25 g of potassium thiocyanate in 200 g of acetone was added to 500 g of the polyether with stirring to prepare a homogeneous solution and then acetone was removed in vacuo to obtain a complex.

50 g of the complex and 1 kg of polypropylene resin were mixed in a biaxial extruder at 180° C. for 10 min. molded with a hot press method at the same temperature under a pressure of 50 kg/cm$^2$ for 2 min. (230 mm×230 mm×3 mm) and surface of the resultant molding was treated with plasma in a gas containing 89 volume % of oxygen and 11 volume % of nitrogen at a gas flow rate of 6.75 l/min under a pressure of 0.2 mmHg at a temperature of 40° C. and at an outlet power of 1,200 W for 1 min. to prepare a test piece.

Then the test piece was grounded and an urethane paint was applied on it by using a painting machine (μμ BEL 30 φ made by Ransburg-Gema AG) under an electrostatic voltage of −60 KV with a recipro stroke of 400 mm, a spray distance of 300 mm and a conveyor velocity of 2.2 m/min.

EXAMPLE 4

45 g of sorbitol was put in a reactor as a starting material and 2,500 g of ethylene oxide and 5,500 g of α-olefine oxide having 6 carbon atoms were sucessively introduced in it by a usual method in the presence of potassium hyroxide as a catalyst. The reaction product was purified by desalting to obtain 7,400 g of a polyether having a molecular weight of 29,700 (calculated from hydroxyl number) and containing 0.35 ppm of $K^+$.

A solution of 25 g of potassium perchlorate in 100 g of methanol was added to 500 g of the polyether with stirring to obtain a homogenious solution and then methanol was removed in vacuo to obtain a complex.

50 g of the complex and 1 kg of polypropylene resin were mixed in a biaxial extruder at 180° C. for 10 min. and the product was molded with a hot press method at the same temperature under a pressure of 50 kg/cm$^2$ for 2 min. (230 mm×230 mm×3 mm) and surface of the resultant molding was treated with plasma in a gas containing 89 volume % of oxygen and 11 volume % of nitrogen at a gas flow rate of 6.75 l/min under a pressure of 0.2 mmHg at a temperature of 40° C. and at an outlet power of 1200 W for 1 min. to prepare a test piece.

Then the test piece was grounded and an urethane paint was applied on it by using a painting machine (μμ BEL 30 φ made by Ransburg-Gema AG) under an electrostatic voltage of −60 KV with a recipro stroke of 400 mm, a spray distance of 300 mm and a conveyor velocity of 2.2 m/min.

COMPARATIVE EXAMPLE 1

1 kg of polypropylene resin was kneaded in a biaxial extruder at 180° C. for 10 min. and the product was molded with a hot press method at the same temperature under a pressure of 50 kg/cm$^2$ for 2 min. (230 mm×230 mm×3 mm) and surface of the resultant molding was treated with plasma in a gas containing 89 volume % of oxygen and 11 volume % of nitrogen at a gas flow rate of 6.75 l/min under a pressure of 0.2 mmHg at a temperature of 40° C. and at an outlet power of 1200 W for 1 min. to prepare a test piece.

Then the test piece was grounded and an urethane paint was applied on it by using a painting machine (μμ BEL 30 φ made by Ransburg-Gema AG) under an electrostatic voltage of −60 KV with a recipro stroke of 400 mm, a spray distance of 300 mm and a conveyor velocity of 2.2 m/min.

The thickness of the urethane film made by electrostatic coating in Examples 1 to 4 and Comparative Example 1 and the coating efficency were as follows.

| | Film thickness (mm) | Coating efficiency |
|---|---|---|
| Example 1 | 36 | 77% |
| Example 2 | 39 | 78% |
| Example 3 | 40 | 80% |
| Example 4 | 34 | 72% |
| Comparative Example 1 | 7 | 25% |

No substantial difference was observed in the other physical properties and color between the products prepared in

EXAMPLES 1 to 4 AND COMPARATIVE EXAMPLE 1.

As described above, according to this inventions, an electrostatic coating of high quality can be applied on the resin having a high surface resistance, which cause an electrostatic coating on the resin to be difficult, with no deterioration in the physical properties.

What is claimed is:

1. A method for applying an electrostatic coating on a resin molding, which comprises the steps of mixing with a resin a complex of a polyether and an electrolyte salt soluble in said polyether, molding the mixture, treating the resultant molding with plasma, and then spray-coating an electrically charged paint on the surface of the treated molding, characterized in that said polyether has a molecular weight of 100,000 or less and is selected from the group consisting of polymers of an alkylene oxide having not less than 4 carbon atoms and block or random alkylene oxide copolymers containing not less than 10 weight % of at least one alkylene oxide unit having not less than 4 carbon atoms, that said electrolyte salt is at least one selected from the group consisting of lithium chloride, lithium bromide, lithium iodide, lithium nitrate, lithium perchlorate, lithium thiocyanate, sodium bromide, sodium iodide, potassium thiocyanate, potassium iodide, lithium sulfonate, organic sulfonates and organic phosphates, and is used in an amount of 0.5 to 10 weight % based on said polyether, and that said complex is used in an amount of 1 to 10 weight % based on said resin.

2. A method as defined in claim 1, wherein said polyether has a molecular weight of 1,000 to 100,000.

3. A resin molding having an electrostatic coating, which is produced by a method comprising the steps of mixing with a resin a complex of a polyether and an electrolyte salt soluble in said polyether, molding and mixture, treating the resultant molding with plasma, and then spray-coating an electrically charged paint on the surface of the treated molding, characterized in that said polyether has a molecular weight of 100,000 or less and is selected from the group consisting of polymers of an alkylene oxide having not less than 4 carbon atoms and block or random alkylene oxide copolymers containing not less than 10 weight % of at least one alkylene oxide unit having not less than 4 carbon atoms, that said electrolyte salt is at least one selected from the group consisting of lithium chloride, lithium bromide, lithium iodide, lithium nitrate, lithium perchlorate, lithium thiocyanate, sodium bromide, sodium iodide, potassium thiocyanate, potassium iodide, lithium sulfonate, organic sulfonates, and organic phosphates, and is used in an amount of 0.5 to 10 weight % based on said polyether, and that said complex is used in an amount of 1 to 10 weight % based on said resin.

* * * * *

UNITED STATES PATENT AND TRADEMARK OFFICE

CERTIFICATE OF CORRECTION

PATENT NO. : 5,137,748

DATED : Aug. 11, 1992

INVENTOR(S) : Fujiwara, et al.

It is certified that error appears in the above-indentified patent and that said Letters Patent is hereby corrected as shown below:

On title page, item [73]

Under "Assignees":

Please replace "Keiyaku Co." to -- Seiyaku Co. Ltd. --.

Signed and Sealed this

Nineteenth Day of September, 1995

*Attest:*

*Attesting Officer*

BRUCE LEHMAN

*Commissioner of Patents and Trademarks*